United States Patent [19]

Cote

[11] Patent Number: 4,846,748

[45] Date of Patent: Jul. 11, 1989

[54] CATHODE-INSERTING MACHINE FOR CATHODE-RAY TUBE

[75] Inventor: Daniel Cote, Ampuis Condrieu, France

[73] Assignee: Videocolor, Montrouge, France

[21] Appl. No.: 200,904

[22] Filed: Jun. 1, 1988

[30] Foreign Application Priority Data

Jun. 5, 1987 [FR] France ..... 87 07945

[51] Int. Cl.[4] ..... H01J 9/06

[52] U.S. Cl. ..... 445/63; 445/67; 445/36

[58] Field of Search ..... 455/3, 4, 34, 36, 63, 455/64, 67

[56] References Cited

U.S. PATENT DOCUMENTS 3,696,491 10/1972 Blumenberg ..... 445/67
3,848,301 11/1974 Gruber ..... 445/34
4,176,432 12/1979 McCandless ..... 445/36
4,449,951 5/1984 Nill ..... 445/34

FOREIGN PATENT DOCUMENTS 3109056 12/1981 Fed. Rep. of Germany .
60-151940 8/1985 Japan .
60-193230 10/1985 Japan .

OTHER PUBLICATIONS

RCA Technical Notes No. 1322, Dec. 1982, pp. 1, 2, Princeton, US; R. E. Schlack et al.: "G1—G2 Compensating Cathode Inserter".

*Primary Examiner*—Kenneth J. Ramsey
*Attorney, Agent, or Firm*—Oblon, Fisher, Spivak, McClelland & Maier

[57] ABSTRACT

The machine of the invention comprises a movable gun support, a calibrated gage rod supported on grid 2, a measuring device to determine the distance between the end of the rod and the cathode and a device to control the gun support.

6 Claims, 2 Drawing Sheets

CATHODE-INSERTING MACHINE FOR CATHODE-RAY TUBE

BACKGROUND OF THE INVENTION

1. Field of the Invention

The present invention relates to a machine for inserting a cathode of a cathode-ray tube.

2. Description of the Prior Art

Machines currently used to insert the electron gun cathodes of cathode-ray tubes generally use complicated and slow instruments, which maintain requisite precision with difficulty, in order to measure the distance between the active face of these cathodes and the grid 1 (or, as the case may be, the grid 2). These machines position the cathode with respect to the grid 1 by first interposing a sensor of fixed length between the cathode and the grid 1, the cathode being placed on a fixed support and the gun on a moving support driven by a roller that works with a cam-shaped groove of a leading screw which is itself driven by a stepping motor.

A first shoulder of this groove determines the position for measuring and setting the position of the cathode, then the gun is drawn back, the sensor is released and the gun is moved forward by a distance equal to that by which it has been moved back plus the length of the sensor, and reaches the position where the cathode is to be soldered in the gun eyelet, this position being also determined by a shoulder of the groove. Thus, any change in the setting of the machine requires the disassembling of the sensor and its re-machining according to new dimensions. The driving device, using a leading screw and roller, is hardly precise: the groove of the leading screw should be completely free of dust or debris and this is difficult to obtain in industrial manufacturing conditions. Even if the stepping motor stops precisely in the desired angular position, the device for coupling with the leading screw which drives it has backlashes which are difficult to take into account. The forces exerted on the roller, both by the gun carriage and the leading screw cause the backlashes of this transmission of motion to be reflected in the carriage.

An object of the present invention is an automatic, fast, precise, reliable and simple machine for the insertion of cathodes in a cathode-ray tube gun.

SUMMARY OF THE INVENTION

The machine according to the invention comprises a gun-supporting device that is moveable parallel to the axis of the gun; a cathode-supporting device which is moveable in a direction substantially perpendicular to the axis of the gun; a gage rod with a calibrated length and a diameter smaller than that of the apertures of the grids other than the first two grids, said gage rod being moveable along the gun axis; a measuring device determining the distance between the active end of a cathode placed in the axis of the gun, at a distance from it, and the free end of the gage rod when it abuts the second grid of the gun; and a device to control the movement of the gun supporting device, said control device working with the position-sensing device.

BRIEF DESCRIPTION OF THE DRAWINGS

The present invention will be better understood from the following detailed description of an embodiment, taken as a non-exhaustive example and illustrated by the appended drawings, of which.

Figure 1:
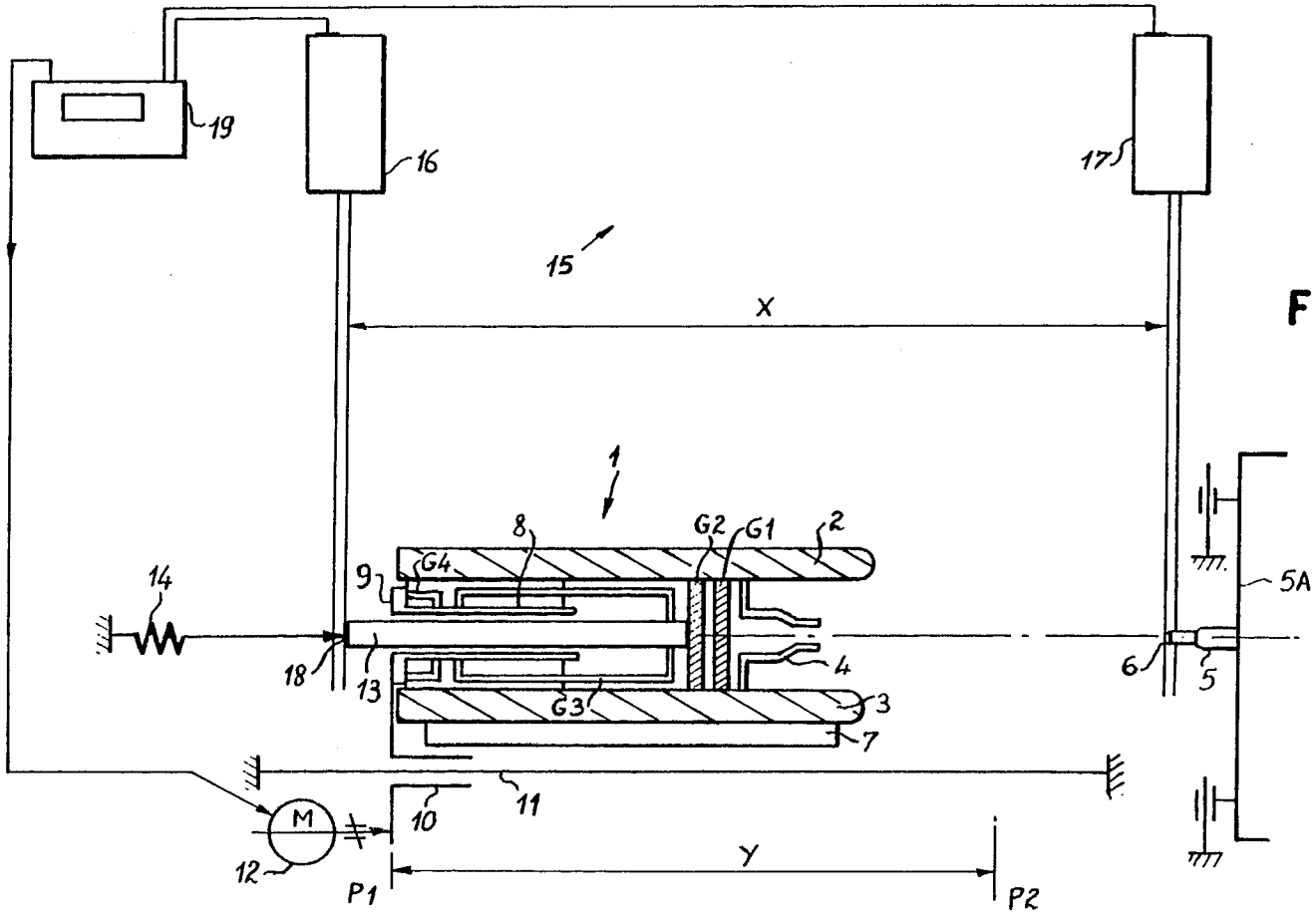
FIG. 1 is a simplified diagram of a machine according to the invention.

Although FIG. 1 relates to a simple gun, it is clear that the invention can be applied to a triple gun of a color cathode tube.

DESCRIPTION OF THE PREFERRED EMBODIMENT

FIG. 1 shows a simplified sectional view of a gun 1 of a cathode tube comprising, in this example, four grids marked G1 to G4, fixed to two ceramic parts, 2, 3, generally called spacers. Of course, the invention also applies to guns having a different number of grids, in particular six grids. The gun 1 also has a cathode-holding eyelet 4, the function of the machine of the invention being to insert a cathode 5 into the eyelet so that the front face 6 of the cathode 5, namely its face to which an emissive coating is applied, is at a defined distance from the grid G1 or the grid G2, and to then solder the cathode 5 to the eyelet 4. The cathode 5 is supported by a supporting device 5A which is movable in a direction substantially perpendicular to the axis of the gun 1.

The gun 1 is placed on a guiding device 7 which is moveable parallel to the axis of the gun. This guiding device 7 may be a slide for example.

The machine has a sleeve 8 with a diameter which is slightly smaller than the diameter of the apertures, to let through electrons, of the grids G3 and G4 (and, if necessary, the grids G5, G6). This sleeve is provided with a collar 9 at one of its ends. The collar 9 is rigidly joined to a moveable bearing 10 which moves on a fixed guide 11, which is parallel to the axis of the gun. The bearing 10 is driven by a motor 12. The length of the sleeve 8 is approximately equal to the length of G3.

A gage rod 13, with a diameter smaller than the internal diameter of the sleeve 8 and with a length greater than the distance between G2 and the front end (side G4) of the gun is moveable along the axis of the gun. The gage rod 13 can be inserted into the gun when the sleeve 8 is itself inserted into the gun, the collar 9 abutting G4 (or G6), and this gage rod 13 is actuated by a suitable automatic mechanism (not shown). A spring 14 or similar device then applies the gage rod against G2.

A measuring device 15, comprising two position sensors 16, 17, for example, optic aiming sensors, that prepare an electrical measurement signal, determines the positions of the free front side 18 of the gage rod 13 and the face 6 of the cathode 5 when the gage rod 13 is applied against G2, the gun 1 being in a fixed withdrawn position Pl (as shown in FIG. 1) and the cathode 5 being positioned in the axis of the gun and being at a distance from said gun. The sensors 16 and 17 are placed in the "nominal" position, i.e. so that, when the cathode 5 has a length substantially equal to its nominal length and when the elements of the gun, in particular its grid G2, are at their nominal position with respect to the spacers (2, 3), the faces 6 and 18 are "seen" substantially at the center of the measuring ranges of the sensors 16, 17, so that, following variations due to the allowable manufacturing tolerances of the gun and the cathode, the faces 6 and 18 can remain in the measuring field of the sensors 16 and 17 regardless of these variations, within the limits of the manufacturing tolerances.

The electrical signals produced by the sensors 16, 17, are sent to a processing device 19 which determines, from these signals, the length Y o the movement that the gun 1 should make towards the cathode 5 in order to reach an inserting position P2 for which the cathode 5 occupies its normal position in the eyelet 4, i.e. when the face 6 of the cathode is at the desired distance from the grid G1 or the grid G2.

Let X be the distance between the faces 6 and 18 for a gun, and a "reference" cathode which has been measured and chosen beforehand. Let L be the length of the gage rod 13, D the distance that should be had between the face 6 and the face of G2 on which the gage rod 13 is supported, and Y the distance between P1 and P2. We then get:

$$Y=X-(L+D)$$

When any cathodes and guns are used with the device described above, the sensors 16, 17, respectively measure the differences X1 and X2 with respect to the measurements made earlier using "reference" elements. Of course, these differences may be positive or negative. We then get:

$$Y=X+X1+X2-(LD)$$

It is then easy for those skilled in the art to make the processing device 19 so that it controls the motor 12 so that the bearing 10 makes a movement of a length Y', the support 7 being then released, and the motor 12 pushes the gun by means of the collar 9 which leans on G4 (or G6).

Of course, the machine of the invention further has a device to solder the cathode 5 in the eyelet 4, for example by laser ray soldering. Since this soldering device is well known per se and is not a part of the invention, it shall not be described herein.

The above-described method for positioning the cathode in the eyelet uses the measurement of the distance between the cathode and G2. This presupposes that the distance G1—G2 is practically constant for all the guns used. If this were not the case, it would be necessary to use the measuring device 20 described below with reference to FIG. 2.

Figure 2:
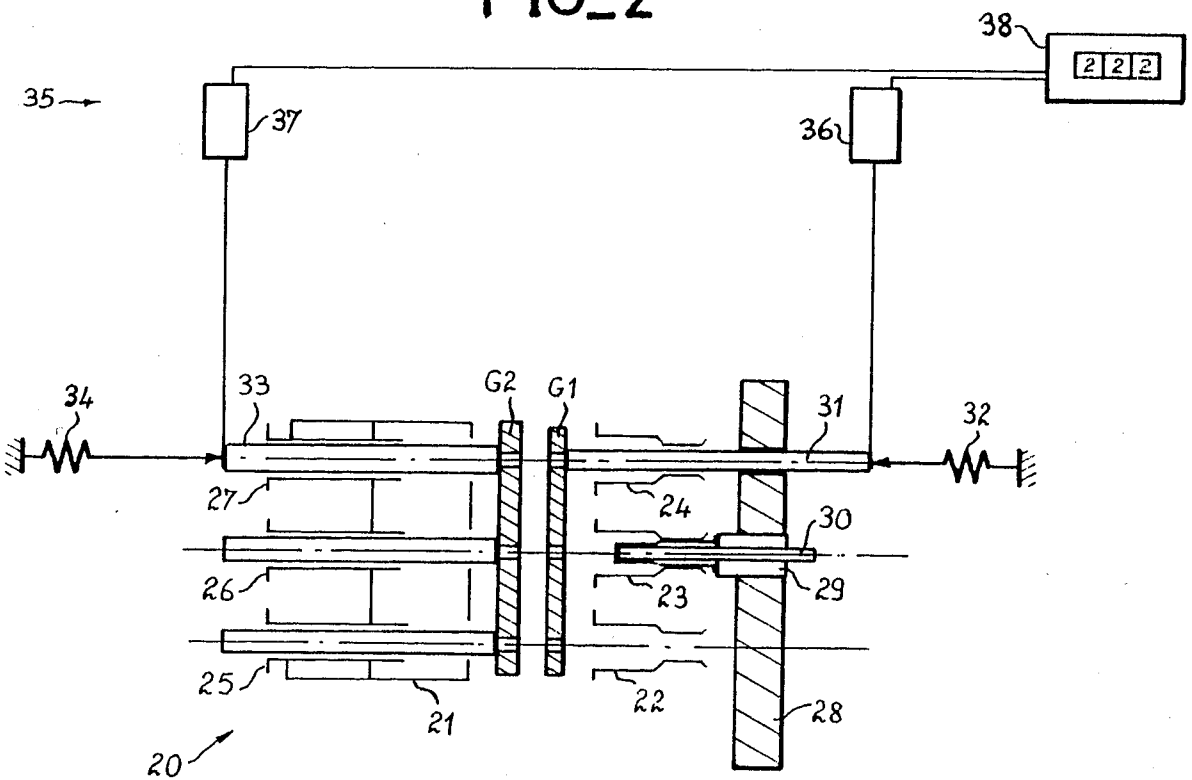
FIG. 2 is a partial diagram of an alternative embodiment of the machine according to the invention which can be used to measure the distance between the first two grids of a cathode tube gun.

The measuring device 20, shown schematically in FIG. 2, is used with a triple gun 21 of a color tube, but it is understood that it can also be used with a single gun.

The triple gun 21 has three individual guns 22 to 24. To increase the speed of the process, the measurements (both the measurements of the cathode-G2 distance as well as the measurements of the distance G1—G2) are made on one of the individual guns (for example, the gun 24 in FIG. 2) while the cathode of a previously measured individual gun (gun 24 for example) is soldered. To simplify the drawing, only two mechanical parts of the machine have been shown: the sleeves 25 to 27 for the guns 22 to 24 respectively (corresponding to the sleeve 8 of FIG. 1) and a support 28 which is moveable in a direction perpendicular to the axes of the guns. The support 28 has a guide 29 into which goes a cathode inserting "electrode" 30. For the example shown, the insertion is done for the individual gun 23.

The support 28 comprises, in the axis of the gun 24, a hole to let through and guide a gage rod 31 applied against G1 by a spring 32.

The gage rod 33, which is similar to the gage rod 13, goes into the sleeve 28 and is applied against G2 by a spring 34.

A measuring device 35, similar to the device 15, comprising sensors 36, 37, determines the distance between the free front sides of the gage rods 31 and 33, respectively, when they abut G1 and G2. The sensors 36, 37 are connected to a processing device 38 which may, if necessary, be part of the device 19. This device 38 measures the difference between the measured distance G1—G2 and the theoretical or nominal value of this distance. This positive or negative difference is added to the value of Y' given above. Thus a value of Y' is obtained, taking into account variations in the distance G1—G2.

The machine of the invention is easy to set and precise. The measuring system is independent of the mechanical part of the machine and therefore does not run the risk of being subject to error due to mechanical backlash. Since the measurement is done without any contact, it is reliable. The setting is done independently for each individual gun of the triple gun.

What is claimed is:

1. A machine for the insertion of cathodes in a cathode-ray tube gun comprising a cathode-supporting device which is moveable in a direction substantially perpendicular to the axis of the gun; a gage rod with a calibrated length and a diameter smaller than that of the apertures of the grids other than the first two grids, said gage rod being moveable along the axis of the gun; a measuring device that determines the distance between the active end of a cathode placed in the axis of the gun, at a distance from it, and the free end of the gage rod when it abuts the second grid of the gun; and a device to control the movement of the gun-supporting device, said control device working in cooperation with the position-sensing device.

2. A machine according to claim 1 comprising a sleeve with an external diameter smaller than the diameter of the apertures of the grids other than the first two grids, and with a length approximately equal to the length of the third grid, said sleeve comprising a collar that is supported on the last grid when it is completely inserted into the gun, said collar being rigidly joined to the movement-controlling device.

3. A machine according to claim 1 or 2 wherein the position sensor comprises optic aiming sensors that prepare an electrical measurement signal.

4. A machine according to claim 1 comprising a device to measure the distance between grid 1 and grid 2, said device comprising a first gage rod that goes into the apertures of the grids other than the first two grids and comes to a stop against the second grid, and a second gage rod that comes to a stop against the first grid on the cathode side, and a measuring device that determines the distance between the free front sides of the two said gage rods abutting the grids 1 and 2 respectively.

5. A machine according to claim 4 wherein the measuring device comprises two optic aiming position sensors that prepare an electrical measurement signal.

6. A machine according to claim 1 for the insertion of cathodes in a triple gun of a color cathode tube wherein said machine simultaneously performs measurements on one of the individual guns and solders the cathode of another previously measured individual gun.

* * * * *